US009655415B2

(12) United States Patent
Feldman et al.

(10) Patent No.: US 9,655,415 B2
(45) Date of Patent: May 23, 2017

(54) RAIN PROTECTION SYSTEM WITH UMBRELLA AND STORED RAIN GEAR

(71) Applicants: Yianni Adam Feldman, New York, NY (US); Sofia Feldman, New York, NY (US)

(72) Inventors: Yianni Adam Feldman, New York, NY (US); Sofia Feldman, New York, NY (US)

( * ) Notice: Subject to any disclaimer, the term of this patent is extended or adjusted under 35 U.S.C. 154(b) by 0 days.

(21) Appl. No.: 14/317,369

(22) Filed: Jun. 27, 2014

(65) Prior Publication Data

US 2015/0282578 A1 Oct. 8, 2015

Related U.S. Application Data

(60) Provisional application No. 61/973,891, filed on Apr. 2, 2014.

(51) Int. Cl.
*A45B 25/00* (2006.01)
*A45B 9/02* (2006.01)

(52) U.S. Cl.
CPC ..... *A45B 25/00* (2013.01); *A45B 9/02* (2013.01); *A45B 2025/003* (2013.01); *A45B 2200/1009* (2013.01); *A45B 2200/1054* (2013.01)

(58) Field of Classification Search
CPC ..... A45B 3/00; A45B 9/02; A45B 2025/003; A45B 2200/1009; A45B 2200/1054; A45B 2200/1081
See application file for complete search history.

(56) References Cited

U.S. PATENT DOCUMENTS

| | | | | |
|---|---|---|---|---|
| 331,095 | A * | 11/1885 | Steinberger | A45B 3/00 135/66 |
| 1,859,627 | A * | 5/1932 | Marsh | A45B 3/00 135/66 |
| 1,931,078 | A * | 10/1933 | McWilliams | A45B 9/02 135/66 |
| 2,044,251 | A * | 6/1936 | McWilliams | A45B 9/02 135/66 |
| 2,312,041 | A * | 2/1943 | Lillie | A45B 9/02 135/66 |
| 3,665,518 | A * | 5/1972 | Leadford | A41D 3/08 2/87 |
| 5,111,835 | A | 5/1992 | Lin | |
| 5,441,064 | A | 8/1995 | Becker et al. | |
| 7,581,555 | B2 | 9/2009 | McCullough | |
| 2003/0228075 | A1 * | 12/2003 | Buchman | B65B 9/093 383/64 |
| 2010/0002962 | A1 * | 1/2010 | Tatsuno | A47G 9/086 383/85 |
| 2011/0155077 | A1 * | 6/2011 | Hurwitz | A01K 13/006 119/850 |
| 2013/0032184 | A1 | 2/2013 | Daly | |
| 2013/0255735 | A1 | 10/2013 | Banerjee | |

* cited by examiner

*Primary Examiner* — David R Dunn
*Assistant Examiner* — Danielle Jackson
(74) *Attorney, Agent, or Firm* — Dilworth & Barrese, LLP.

(57) ABSTRACT

A rain protection system is provided herein which includes, (a) an umbrella having a canopy mounted to a post, and a handle at a lower end of the post, the handle having an open bottom end and having a hollow axial cavity; and (b) rain gear which is adapted to be removably insertable into said hollow axial cavity.

15 Claims, 5 Drawing Sheets

RAIN PROTECTION SYSTEM WITH UMBRELLA AND STORED RAIN GEAR

CROSS REFERENCE TO RELATED APPLICATIONS

The present application claims priority to U.S. provisional application No. 61/973,891 filed Apr. 2, 2014, the entire contents of which is herein incorporated by reference.

BACKGROUND

1. Field of the Invention

The present invention relates to a rain protection system with an umbrella having a handle including a compartment for storing rain gear.

2. Background of the Art

It is known in the art to modify conventional umbrellas for various purposes. For example, U.S. Pat. No. 5,111,835 discloses a folding umbrella having a water collecting handle and a sheath such that water on a rain dampened umbrella drips into the water collecting handle.

U.S. Publication No. 2013/0255735 is directed to a multi-fold umbrella combined with a writing implement or cosmetic case such that the umbrella can be stored in its own handle.

U.S. Pat. No. 5,441,064 is directed to a combination umbrella and rain cover storage system and discloses an umbrella having pockets for storing leggings.

U.S. Pat. No. 7,581,555 is directed to an umbrella with a compartment adapted to hold a planar sheet of material for covering an individual's back.

Conventional umbrellas protect an individual from precipitation by providing an overhead canopy. However, when rain or other precipitation is blown sideways, especially in high or gusty winds, it is difficult to avoid one's clothing getting wet or even drenched since conventional umbrellas typically leave most of the individual's body exposed. Also, conventional umbrellas do not protect an individual from becoming wet when sitting outdoors.

To protect most of the body from getting wet, individuals often rely on wearing rain gear such as a poncho, raincoat, slicker, jacket or cape. Preferably, the rain gear is used together with an umbrella: the umbrella providing an overhead canopy and the poncho, raincoat, slicker, jacket or cape providing protection from sideways driven precipitation. Therefore, while it is desirable to have both an umbrella and rain gear available for protection from the possibility of a rainstorm, it is inconvenient to carry them separately.

Accordingly, it would be desirable for an individual to be provided with a convenient rain protection system whereby the rain gear such as a poncho, raincoat, slicker, jacket or cape can be carried together with the umbrella as a unit such that the rain gear can be retrieved for use during inclement weather conditions, thereby eliminating the need to carry the umbrella and rain gear separately.

SUMMARY

A rain protection system is provided herein which comprises, (a) an umbrella having a foldable canopy mounted to a post and a hollow handle at a lower end of the post, the handle having an axial cavity; and (b) rain gear which is adaptable to be removably insertable into the axial cavity in the handle. The rain protection system of the invention provides a convenient way of carrying an umbrella with rain gear and is useful for both adults and children.

BRIEF DESCRIPTION OF THE DRAWINGS

Various embodiments are described below with reference to the drawings wherein.

DETAILED DESCRIPTION OF PREFERRED EMBODIMENT(S)

Figure 1:
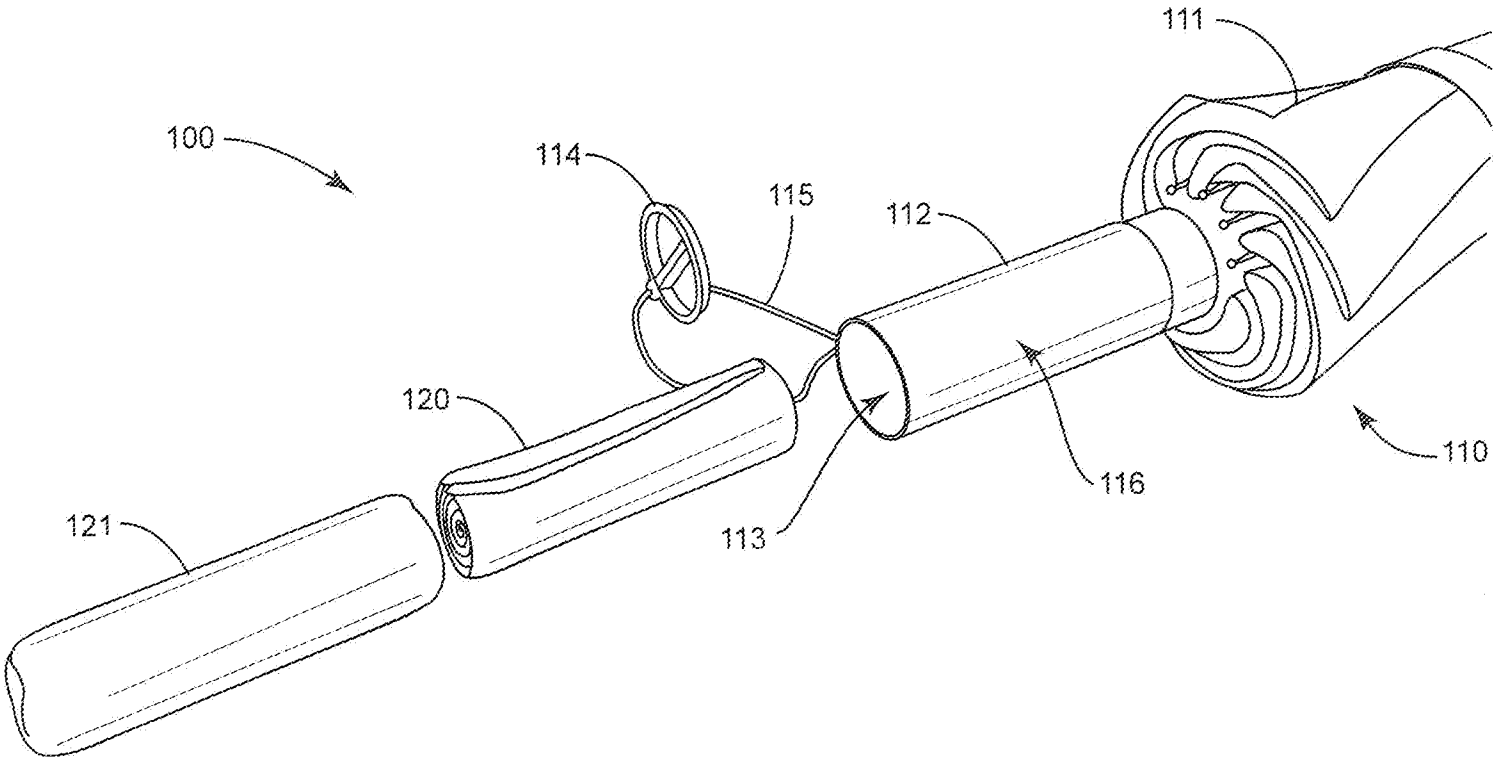
FIG. 1 is an exploded perspective view of the rain protection system.

Referring now to FIG. 1, the present invention comprises a rain protection system 100 which includes an umbrella 110, rain gear 120 and optionally a casing 121 for containing the rain gear 120 in a rolled up configuration. As used herein, the term "rain gear" can include any type of garment for protection from rain or other type of precipitation such as snow, sleet, hail and the like. Non-limiting examples of rain gear can include ponchos, raincoats, slickers, jackets or capes. For the purposes of the present invention, the rain gear is preferably disposable.

Figure 4:
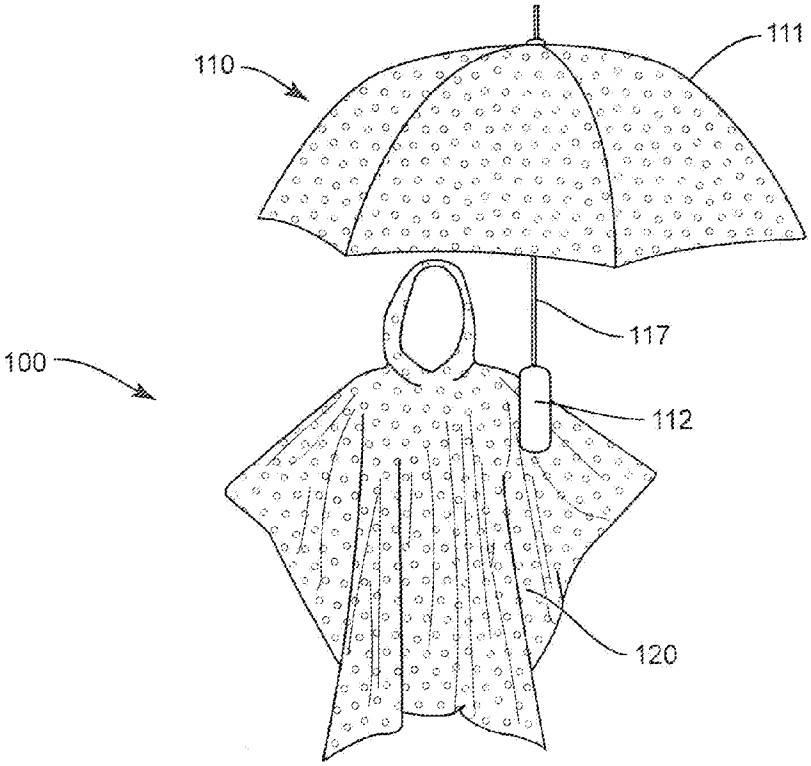
FIG. 4 is a front devotional view showing a poncho and umbrella in an opened configuration.

More particularly, the umbrella 110 can be for example, any type of typically used umbrella such as a traditional umbrella (i.e., a stick umbrella optionally with a telescopic shaft or post), pop-up or collapsible folding umbrella such as those which may fit into a handbag or carry case. The umbrella 110 includes an openable canopy 111 mounted to a post, or shaft, 117 (FIG. 4). Hollow handle 112 at the bottom end of the post 117 is preferably cylindrical in shape and has a top wall, sidewall(s) and an open bottom so as to define an axial hollow inner cavity 113 having sufficient space in which to store the rain gear (e.g., poncho, raincoat, slicker, jacket or cape) 120 in a rolled up configuration. Optionally, the hollow handle 112 can alternatively have an oval or polygonal cross section. Handle 112 can be fabricated from any material suitable for the use described herein such as, for example a rigid plastic material.

Figure 3:
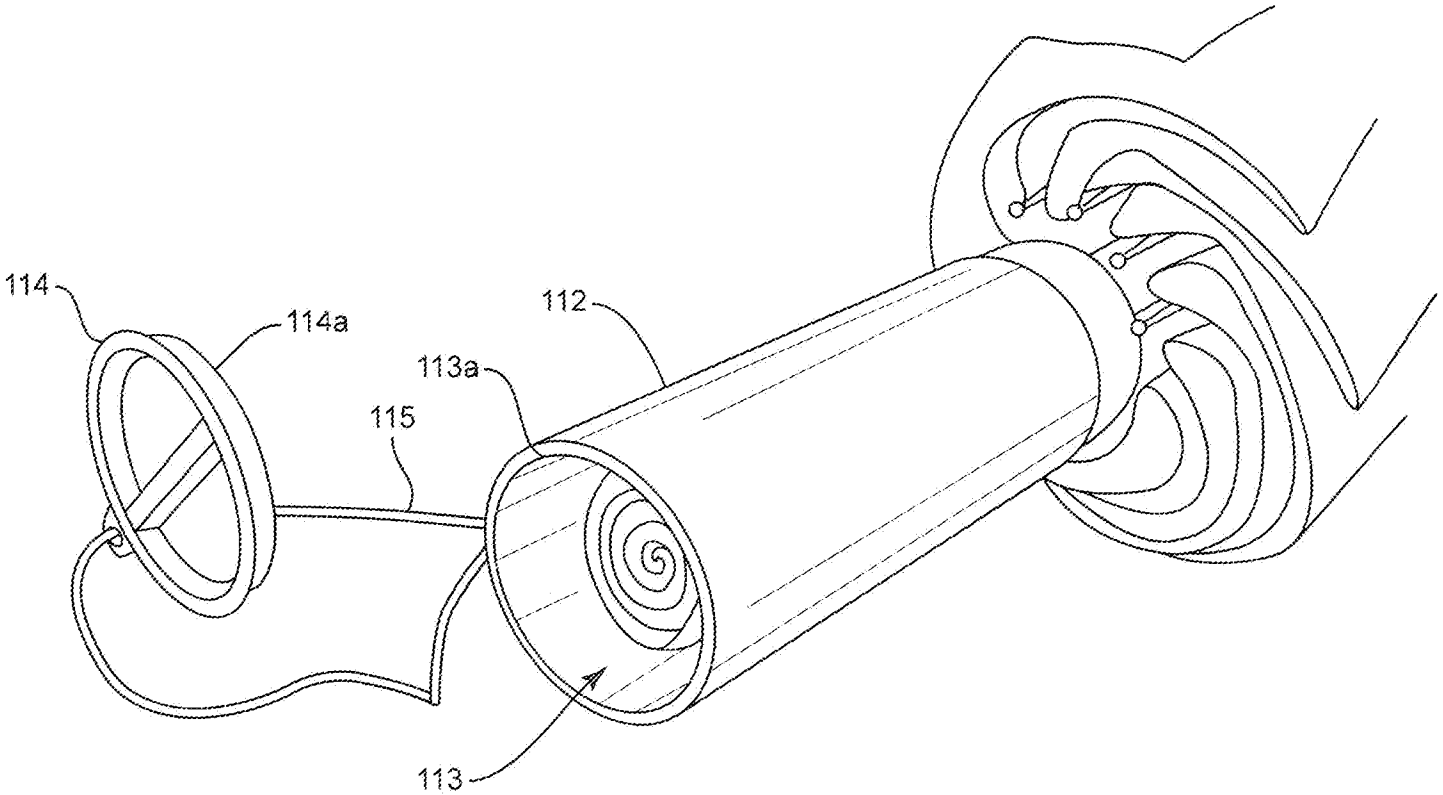
FIG. 3 illustrates the module inserted into the hollow handle, of the umbrella.

Handle 112 includes a cap 114 which is adapted to close the open bottom portion 113*a* of the handle 112 (FIG. 3). The cap 114 can be attached to the bottom portion of the handle 112 by any suitable manner to prevent loss of the cap, and preferably by a flexible loop 115 such as, for example, a cord fabricated from a polymeric material, such as nylon, or other suitable material. The cap 114 can be constructed so as to attach to the open bottom portion 113*a* of the handle by screw engagement or snap-fit engagement. For example, cap 114 can have a rim 114*a*, which is threaded along the perimeter for screw engagement, or is resiliently flexible for snap-fit engagement. The loop 115 keeps the cap 114 connected to the handle 112 to prevent loss of the cap 114. Also, the loop 115 may be wrapped around a user's wrist to facilitate carrying and holding of the umbrella. In an embodiment, the handle 112 can also include indicia 116 on an outer surface such as a logo, text and the like.

In an embodiment, the rain gear 120 comprises a poncho which is fabricated from a thin, water proof material such as plastic which, in a rolled up configuration, can fit into the hollow axial cavity 113 of the hollow handle. It will be understood that the poncho 120 is just an example of suitable rain gear and any other type of rain gear such as, for example, a raincoat, slicker, jacket or cape, may be used in the present invention if suitably constructed for the use described herein.

Figure 2:
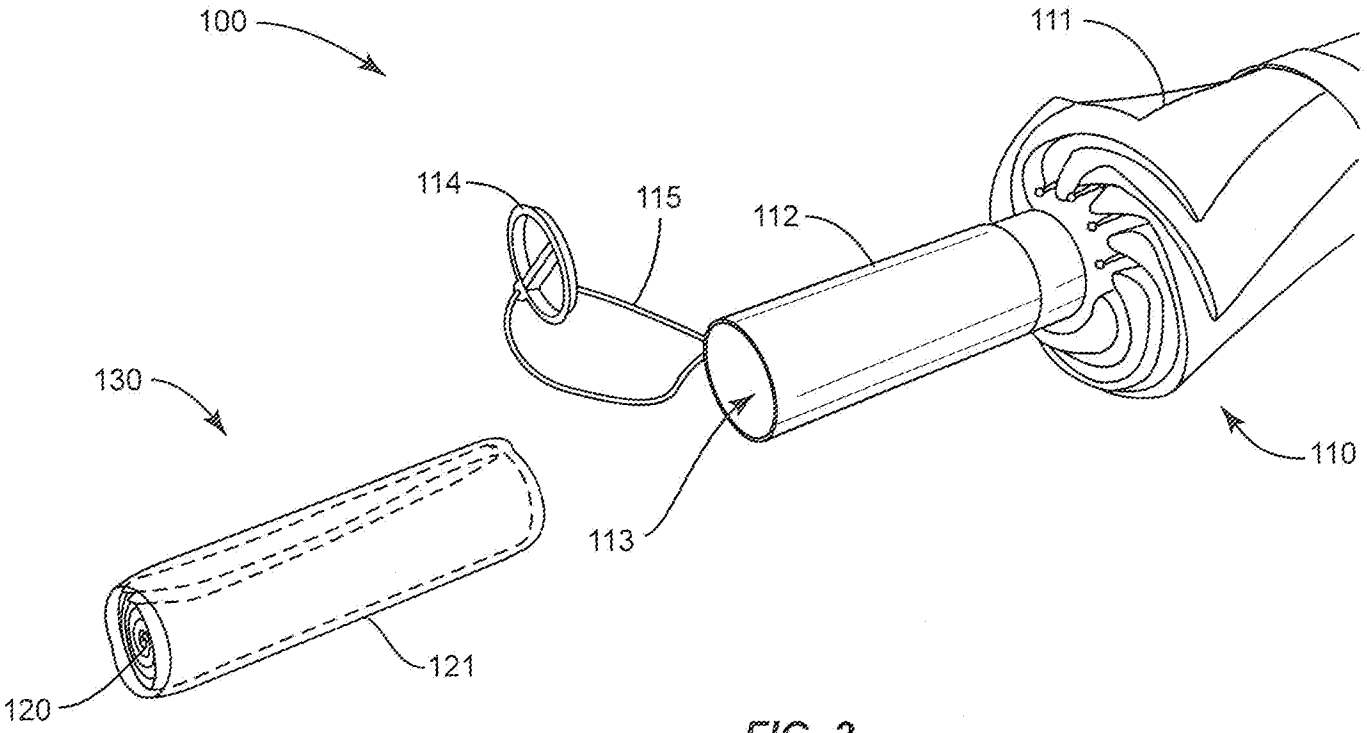
FIG. 2 is an exploded perspective view showing a module comprising the rain gear wrapped in a casing prior to insertion of the module into the handle of the umbrella.

In an embodiment, the rolled-up poncho 120 can be contained in a casing 121 fabricated, for example, from a thin polymeric plastic material so as to prevent the poncho 120 from unrolling. The casing 121 can be of a generally tubular configuration with one or both ends open. Casing 121 is optionally fabricated from a transparent material to allow the user to visualize the poncho contained therein and may also include indicia on a surface thereof such as a logo, text and the like. The casing 121 and the rolled up poncho 120 contained in the casing 121 together provide a generally cylindrical module 130 (FIG. 2) for convenient insertion into and withdrawal from hollow axial cavity 113 as shown in FIG. 3.

The poncho 120 and the casing 121 are preferably disposable so that each can be discarded after use. In an embodiment, the rain protection system includes multiple modules 130 with which to refill the handle 112 after use.

Figure 5:
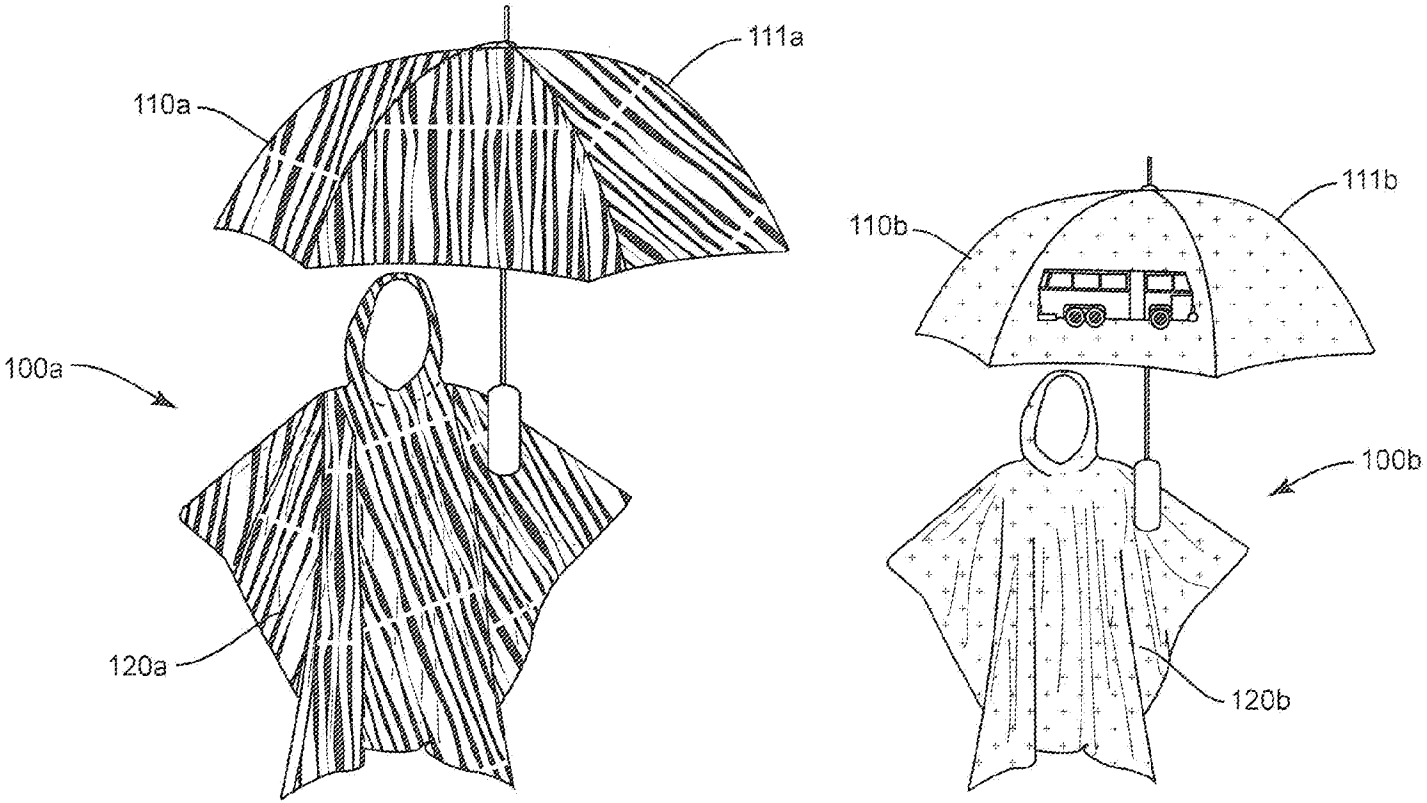
FIG. 5 is a front elevational view of two additional embodiments of the invention in an opened configuration.

In use, the openable end 113*a* of the handle 112 is uncapped and the module 130 is withdrawn from cavity 113. The poncho 120 is removed from casing 121, for example by tearing open the casing, unrolled and opened so that it can be worn by the user as shown in FIGS. 4 and 5. After, use, the poncho 120 and casing 121 can be discarded and the user may replace the poncho in the umbrella handle 112 by inserting a new refill module 130 into hollow axial cavity 113.

In an embodiment as shown in FIG. 5, the poncho and umbrella canopy can include matching designs and patterns. In this way, the user is able to identify which poncho is associated with a particular umbrella. For example, rain protection system 100A includes a poncho 120A having a pattern which matches the pattern on canopy 111A of umbrella 110A. Likewise, system 100B includes a poncho 120B which has a color matching the color of canopy 111B on umbrella 110B. Canopy 111B may also have an illustration, as well as the poncho.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A rain protection system comprising:

an umbrella having a canopy mounted to a post, and a handle at a lower end of the post, the handle having a first end attached to the post and a second end opposite the first end having a removably attachable cap on an open bottom of the second end, the handle having a hollow axial cavity; and a module comprising said rain gear contained within a casing, the module positioned inside the hollow axial cavity having sufficient space to store the module, wherein the module is separate from and not attached to the cap, and the casing is a tearable thin polymeric plastic material.

2. The rain protection system of claim 1, wherein the umbrella is a collapsible folding umbrella.

3. The rain gear protection system of claim 1 wherein the rain gear comprises a poncho, raincoat, slicker, jacket, or cape.

4. The rain protection system of claim 1 comprising at least two modules.

5. The rain protection system of claim 1 wherein the rain gear and casing are disposable and replaceable.

6. The rain protection system of claim 1 wherein the handle has a generally cylindrical shape.

7. The rain protection system of claim 1 wherein the handle has an oval or polygonal cross section.

8. The rain protection system of claim 1 wherein the cap engages the open bottom end of the handle by a screw engagement or snap-fit engagement.

9. The rain protection system of claim 1 further comprising a flexible loop attached to the handle and securing the cap thereto.

10. The rain protection system of claim 1 wherein the rain gear and umbrella canopy each include a matching pattern and/or color.

11. The rain protection system of claim 1 wherein the handle includes indicia on an outer surface thereof.

12. A modular rain protection system comprising:

an umbrella having a canopy mounted to a post, and a handle at a lower end of the post;

the handle having a first end and a second end opposite the first end, the second end having a removably attachable cap, the handle having a hollow axial cavity; and a plurality of modules, each module containing a rain gear in a rolled-up configuration and each said module being configured and dimensioned so as to be removably insertable into the axial cavity of the handle and stored therein, wherein:

a first module of the plurality of modules contains a first rain gear, the first rain gear is one of a poncho, raincoat, slicker, jacket, or cape; and a second module of the plurality of modules contains a second rain gear, the second rain gear is one of a poncho, raincoat, slicker, jacket, or cape, and the second rain gear is different than the first rain gear;

wherein one of the first module or the second module is positioned inside the hollow axial cavity, and wherein removal of the cap directly exposes the first module or the second module.

13. The modular rain protection system of claim 12, wherein the umbrella is a collapsible folding umbrella.

14. A method of rain protection comprising:

providing a modular rain protection system which includes, an umbrella having a canopy mounted to a post, and a handle at a lower end of the post, the handle having a first end attached to the post and a second end opposite the first end having a removably attachable cap on an open bottom of the second end, the handle defining a hollow axial cavity therein, and a module comprising rain gear contained within a casing, the module being configured and dimensioned so as to be removably insertable into the hollow axial cavity of the handle and stored therein, the cavity having sufficient space to store the module;

completely removing the cap from the open bottom of the second end of the handle, wherein the module is still positioned within the hollow axial cavity of the handle when the cap is completely removed;

removing the module from the hollow axial cavity of the handle after the cap is completely removed; and tearing open the casing to access the rain gear positioned therein.

15. The method of claim 14 further comprising the step:

inserting another module into the hollow axial cavity of the umbrella handle;

attaching the cap to the open bottom of the second end of the handle.

* * * * *